US010420422B2

(12) United States Patent
Lawson et al.

(10) Patent No.: US 10,420,422 B2
(45) Date of Patent: Sep. 24, 2019

(54) RECLINER CHAIR HAVING IMPROVED WALL CLEARANCE AND RECLINE LINKAGE WITH PROJECTED BACK PIVOT POINT

(71) Applicant: L&P Property Management Company, South Gate, CA (US)

(72) Inventors: Gregory Mark Lawson, Tupelo, MS (US); Walter Clark Rogers, Jr., New London, NC (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 15/657,425

(22) Filed: Jul. 24, 2017

(65) Prior Publication Data

US 2018/0027968 A1 Feb. 1, 2018

Related U.S. Application Data

(60) Provisional application No. 62/368,728, filed on Jul. 29, 2016.

(51) Int. Cl.
*A47C 1/02* (2006.01)
*A47C 1/035* (2006.01)
(Continued)

(52) U.S. Cl.
CPC ..... *A47C 1/03211* (2013.01); *A47C 1/0355* (2013.01)

(58) Field of Classification Search
CPC ... A45C 1/0355; A45C 1/0342; A45C 1/0352; A45C 1/024; A45C 3/00
See application file for complete search history.

(56) References Cited

U.S. PATENT DOCUMENTS 3,730,584 A 5/1973 Uchida
4,071,275 A 1/1978 Rogers, Jr.
(Continued)

FOREIGN PATENT DOCUMENTS

FR 1255403 A 3/1961
WO 2014139179 A1 9/2014

OTHER PUBLICATIONS

Notice of Allowance dated Sep. 6, 2018 in U.S. Appl. No. 15/485,711, 9 pages.
(Continued)

*Primary Examiner* — Shin H Kim
(74) *Attorney, Agent, or Firm* — Shook, Hardy & Bacon, LLP

(57) ABSTRACT

A linkage mechanism for a reclining seating unit that provides increased back support, reduces shirt pull and decreases minimum wall clearance. The linkage mechanism may include a seat mounting plate indirectly coupled to a back bracket where the back bracket pivots around a projected pivot point located forwardly and upwardly from the back bracket when the seating unit is closed. The linkage mechanism may include an intermediate link pivotally connected to the seat mounting plate and the back bracket, a back pivot link pivotally connected to the back bracket and a rear lift link, the rear lift link pivotally connected to the seat mounting plate, and a control link pivotally connected to the back pivot link and the seat mounting plate. Forward movement of the back bracket relative to the seat mounting plate as the seating unit reclines reduces the wall clearance needed behind the seating unit below 4.5 inches.

19 Claims, 8 Drawing Sheets

(51) Int. Cl.
*A47C 1/032* (2006.01)
*A47C 1/0355* (2013.01)

(56) References Cited

U.S. PATENT DOCUMENTS

| | | | | |
|---|---|---|---|---|
| 4,108,491 | A | 8/1978 | Rogers, Jr. | |
| 4,194,783 | A | 3/1980 | Cycowicz et al. | |
| 4,591,205 | A | 5/1986 | James | |
| 4,815,788 | A * | 3/1989 | May | A47C 1/0355 297/318 |
| 4,904,019 | A * | 2/1990 | May | A47C 1/0355 297/68 |
| 5,072,988 | A * | 12/1991 | Plunk | A47C 1/0352 297/68 |
| 5,765,913 | A | 6/1998 | Lapointe et al. | |
| 5,772,278 | A * | 6/1998 | Kowalski | A47C 1/0355 297/85 L |
| 5,795,021 | A | 8/1998 | Rogers | |
| 7,396,074 | B2 * | 7/2008 | Wiecek | A47C 1/0355 297/68 |
| 7,850,232 | B2 * | 12/2010 | Casteel | A47C 1/0352 297/68 |
| 8,398,165 | B2 | 3/2013 | Lawson | |
| 8,398,169 | B2 * | 3/2013 | LaPointe | A47C 1/0355 297/260.2 |
| 8,573,687 | B2 * | 11/2013 | Lawson | A47C 1/0355 297/84 |
| 8,616,627 | B2 | 12/2013 | Murphy et al. | |
| 8,714,638 | B2 * | 5/2014 | Hoffman | A47C 1/0342 297/83 |
| 8,833,844 | B2 | 9/2014 | LaPointe et al. | |
| 8,915,544 | B2 | 12/2014 | LaPointe | |
| 8,985,694 | B2 * | 3/2015 | Fischer | A47C 1/0355 297/423.19 |
| 9,039,078 | B2 * | 5/2015 | Lawson | A47C 1/035 297/330 |
| 9,247,822 | B2 * | 2/2016 | Fischer | A47C 1/0352 |
| 9,468,295 | B2 * | 10/2016 | Lawson | A47C 1/0355 |
| 9,585,477 | B2 * | 3/2017 | Huang | A47C 1/0355 |
| 9,700,140 | B2 * | 7/2017 | Lawson | A47C 1/0342 |
| 9,844,269 | B2 * | 12/2017 | Bryant | A47C 1/034 |
| 9,845,852 | B2 * | 12/2017 | Lawson | F16H 25/20 |
| 10,021,980 | B2 * | 7/2018 | Lawson | A47C 1/0355 |
| 2002/0043823 | A1 | 4/2002 | Wiecek | |
| 2010/0127556 | A1 | 5/2010 | Hoffman et al. | |
| 2011/0248536 | A1 * | 10/2011 | LaPointe | A47C 1/0355 297/273 |
| 2012/0049606 | A1 * | 3/2012 | Lawson | A47C 1/0355 297/85 M |
| 2012/0112519 | A1 | 5/2012 | Murphy et al. | |
| 2013/0200659 | A1 | 8/2013 | Hoffman et al. | |
| 2013/0257110 | A1 * | 10/2013 | Fischer | A47C 1/0355 297/83 |
| 2014/0333108 | A1 * | 11/2014 | Fischer | A47C 1/0352 297/311 |
| 2015/0108812 | A1 * | 4/2015 | Huang | A47C 1/0355 297/354.12 |
| 2015/0289655 | A1 * | 10/2015 | Lawson | A47C 1/0342 297/75 |
| 2016/0029800 | A1 * | 2/2016 | Bryant | A47C 1/034 297/284.3 |
| 2016/0045031 | A1 * | 2/2016 | Lawson | A47C 1/0345 297/284.3 |
| 2016/0100687 | A1 | 4/2016 | Murphy et al. | |
| 2016/0273632 | A1 * | 9/2016 | Lawson | F16H 25/20 |
| 2017/0135486 | A9 * | 5/2017 | Lawson | A47C 1/0342 |

OTHER PUBLICATIONS

Extended Search Report dated Feb. 19, 2018 in European Patent Application No. 17183598.6, 8 pages.
Extended Search Report dated Feb. 19, 2018 in European Patent Application No. 17182541.7, 7 pages.
Extended Search Report dated Apr. 25, 2018 in European Patent Application No. 17183713.1, 8 pages.
Communication pursuant to Article 94(3) dated Oct. 18, 2018 in European Patent Application No. 17183598.6, 5 pages.
Communication under Rule 71(3) dated Jan. 10, 2019 in European Patent Application No. 17183713.1, 35 pages.

* cited by examiner

RECLINER CHAIR HAVING IMPROVED WALL CLEARANCE AND RECLINE LINKAGE WITH PROJECTED BACK PIVOT POINT

CROSS-REFERENCE TO RELATED APPLICATIONS

This application claims priority to U.S. Provisional Application No. 62/368,728 filed Jul. 29, 2016. The entirety of the aforementioned application is incorporated by reference herein.

BACKGROUND

Recliners are generally well known in the furniture industry. The term recliner is used throughout this description to describe articles of furniture that include a reclining mechanism. Generally recliners are chairs that allow the user to recline and are equipped with extendable footrests. Recliners are often in the form of a plush chair, however, they might also take the form of an oversized seat, a seat-and-a-half, a love seat, a sofa, a sectional, and the like. Recliners are known in both a manual configuration (where the user releases the reclining mechanism from a closed position to a TV position, and moves the reclining mechanism from the TV position to a full recline position) and a motorized version (where a motor is used to move the mechanism between the various positions).

The reclining motion is achieved in recliners with a linkage mechanism that is coupled to a base. The linkage mechanisms found in recliners in the art include a plurality of interconnected links that provide one or more mechanisms for extending a footrest, reclining the recliner, and obstructing movements of the chair when in specific orientations. Typically, recliners known in the art provide three positions: an upright seated position with the footrest retracted beneath the chair (the "closed position"); a television viewing position in which the chair back is slightly reclined but still provides a generally upright position with the footrest extended (the "TV position"), and a full-recline position in which the chair back is reclined an additional amount farther than in the TV position but still generally inclined with respect to the seat of the chair and with the footrest extended (the "fully reclined position").

These types of prior art recliner mechanisms, while functional, suffer from a number of drawbacks. One of which includes a problem known as shirt pull. Shirt pull occurs as the user reclines the back of the chair, and the chair back rotates back, but also away from the seat, increasing the distance between the bottom of the back cushion and the back of the seat cushion. This movement not only results in shirt pull, but also removes support from the lower lumbar area of the user seated in the chair. In some cases, a gap may form between the seat cushion and the back cushion resulting in discomfort to the user seated in the chair. This motion is caused by a back bracket pivot point that is typically below and behind the point where the chair back cushion and the seat cushion meet. It would be desirable to provide a recliner, whether manual or motorized, having a back pivot point projected to as close as possible to the point at which the bottom of the back cushion and the back of the seat cushion meet.

Further, recliners typically move forward when changing from the closed position to the TV position, and from the TV position to the fully reclined position to accommodate the reclining of the back and the shifting of the center of gravity of the recliner and the user seated therein. Moreover, in order to provide as much wall clearance as possible, recliners have moved forward as much as possible. Recliners known in the art have a minimum wall clearance of 4.5 inches in order to fully move between the closed position, the TV position, and the fully reclined position. The amount of wall clearance is limited principally by two factors, the angle relative to a base rail of front and rear pivot links in the closed position and the arcs about which they may travel and the length of the front and back pivot links. In the closed position, known pivot links are set at an angle just forward of normal to the base rail. This allows gravity to assist the user of the chair to move from the closed position to the TV position. It would be desirable to provide a recliner having a wall clearance less than 4.5 inches, and as small as possible, to allow the user as much freedom as possible when positioning the recliner in a room.

BRIEF SUMMARY

Embodiments of the invention are defined by the claims below, not this summary. A high-level overview of various aspects of the invention are provided here for that reason, to provide an overview of the disclosure, and to introduce a selection of concepts that are further described below in the detailed-description section. This summary is not intended to identify key features or essential features of the claimed subject matter, nor is it intended to be used as an aid in isolation to determine the scope of the claimed subject matter.

In an embodiment of the invention a linkage for use in reclining furniture is described. The linkage includes a back bracket supported by forward and rear back pivot links. The bottom of the rear back pivot link is pivotally coupled to a rear lift link, and the bottom of the forward back pivot link is pivotally coupled to a seat mounting plate, and the rear lift link is pivotally coupled to the seat mounting plate at a different location. A control link is pivotally coupled on one end to the seat mounting plate and on the other end to an intermediate point on the rear back pivot link. The control link operates to pull the pivoting linkage of the back bracket, and the forward and rear back pivot links as the overall linkage is moved from the closed position, to the TV position, and to the full recline position. The resulting pivot point for the back of the recliner is projected upwardly and forwardly, to a point where an upholstered back and seat meet on a finished chair, resulting in far less shirt pull than in previously known mechanisms and chairs. During recline, the bottom of the back of the chair will follow the user, offering full support of the user's back and avoid the undesirable gap between cushions, even in the full-recline position.

The back bracket rotating about the projected pivot point in the linkage described above allows for a decreased minimum wall clearance than in previously known mechanisms and chairs. When the recliner moves from the closed position to the TV position, and from the TV position to the fully reclined position, the back bracket moves forward allowing the back of the chair to recline while providing additional clearance. In other words, the forward movement associated with the projected pivot point allows the recliner to be placed closer to the wall than previously known mechanisms and chairs.

In another embodiment, the linkage is supported above a base rail by front and rear pivot links. In a motorized version, the rear pivot link may be set at an angle behind normal to the base rail, which provides a longer arc for the rear pivot link to travel. Hence, in addition to the additional forward movement due to the projected pivot point disclosed above, the motorized version may include even more forward movement due to the longer arc of travel for the rear pivot link. This embodiment can eliminate wall clearance for the recliner entirely and the recliner can be placed adjacent a wall and still move between the closed position and the fully reclined position without contacting the wall.

BRIEF DESCRIPTION OF THE DRAWINGS

Illustrative embodiments of the invention are described in detail below with reference to the attached drawing figures, and wherein.

DETAILED DESCRIPTION

The subject matter of embodiments of the invention is described with specificity herein to meet statutory requirements. But the description itself is not intended to necessarily limit the scope of claims. Rather, the claimed subject matter might be embodied in other ways to include different steps, components, or combinations thereof, in conjunction with other present or future technologies. Terms should not be interpreted as implying any particular order among or between various steps herein disclosed unless and except when the order of individual steps is explicitly described.

Figure 1:
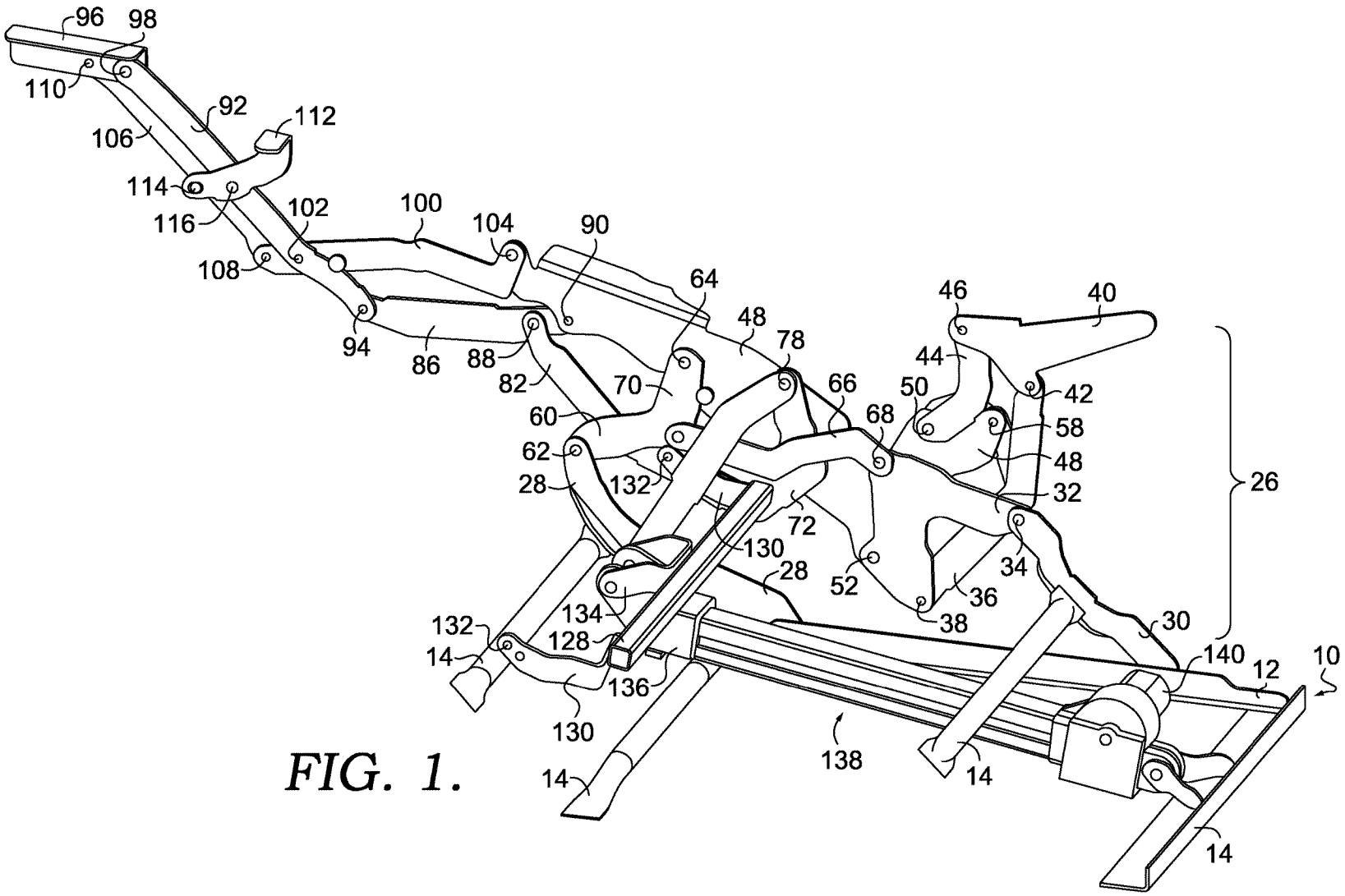
FIG. 1 depicts a perspective view of a portion of an exemplary motorized recliner mechanism in accordance with an embodiment hereof.

Referring to the drawings and initially to FIG. 1, a portion of a recline mechanism of a recliner is shown in a fully reclined position in accordance with an embodiment of the invention. The recliner mechanism couples together a footrest, chair back, chair arms and a chair seat of a recliner. For the sake of clarity, these portions of the chair are not shown. The recline mechanism may include a linkage mechanism coupled to a base. Often, the recline mechanism includes a pair of linkage mechanisms (e.g., a left linkage mechanism and a right linkage mechanism) coupled to the base. For clarity, only one linkage mechanism is shown in the figures. In aspects with a pair of linkage mechanisms, the side not shown may be a mirror image of the side that is shown. The illustrated recline mechanism is a motorized recline mechanism where a motor causes the recliner to move between a closed position and one of a plurality of open positions (e.g., a TV position, a fully-reclined position, an intermediate position). The following description, however, applies equally to a manual recline mechanism (as is shown in FIGS. 2-7).

FIG. 1 illustrates an exemplary recline mechanism having a linkage mechanism 26 pivotally coupled to a base 10. The base 10 may comprise a base rail 12 made from angle steel, as in the illustrated aspect. The base rail 12 supports the linkage mechanism 26 and the remainder of the chair above the surface on which the recliner is placed. In aspects where the recline mechanism includes a pair of linkage mechanisms 26, the base 10 may include a pair of spaced apart base rails 12 coupled to the pair of linkage mechanisms 26. One or more cross-members 14 may connect portions of the base 10 and/or the pair of linkage mechanisms 26. In some aspects, the cross-members 14 are made from angle steel or tubular steel and may be affixed to the base 10 and/or the linkage mechanisms 26, such as with bolts.

Figure 2:
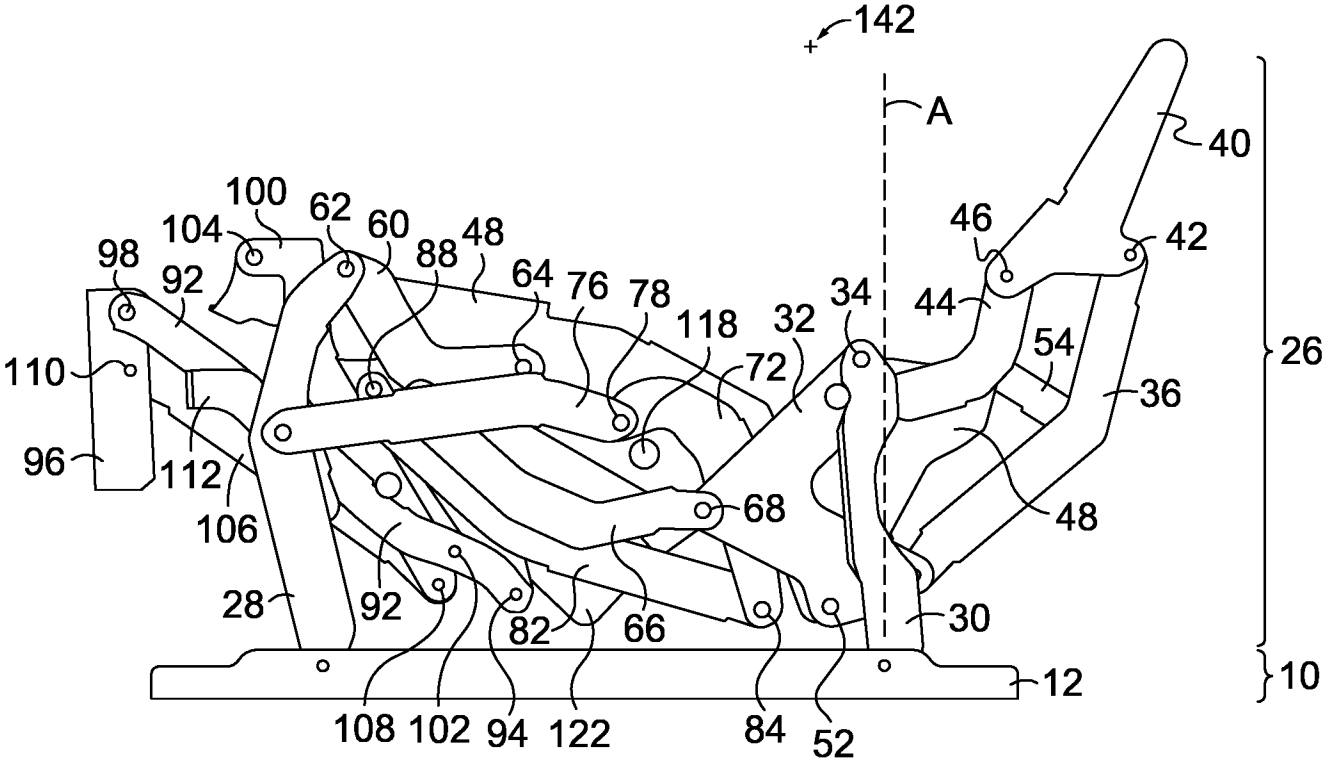
FIG. 2 depicts an inside elevation view of an exemplary manual recliner mechanism in the closed position in accordance with an embodiment hereof.
Figure 3:
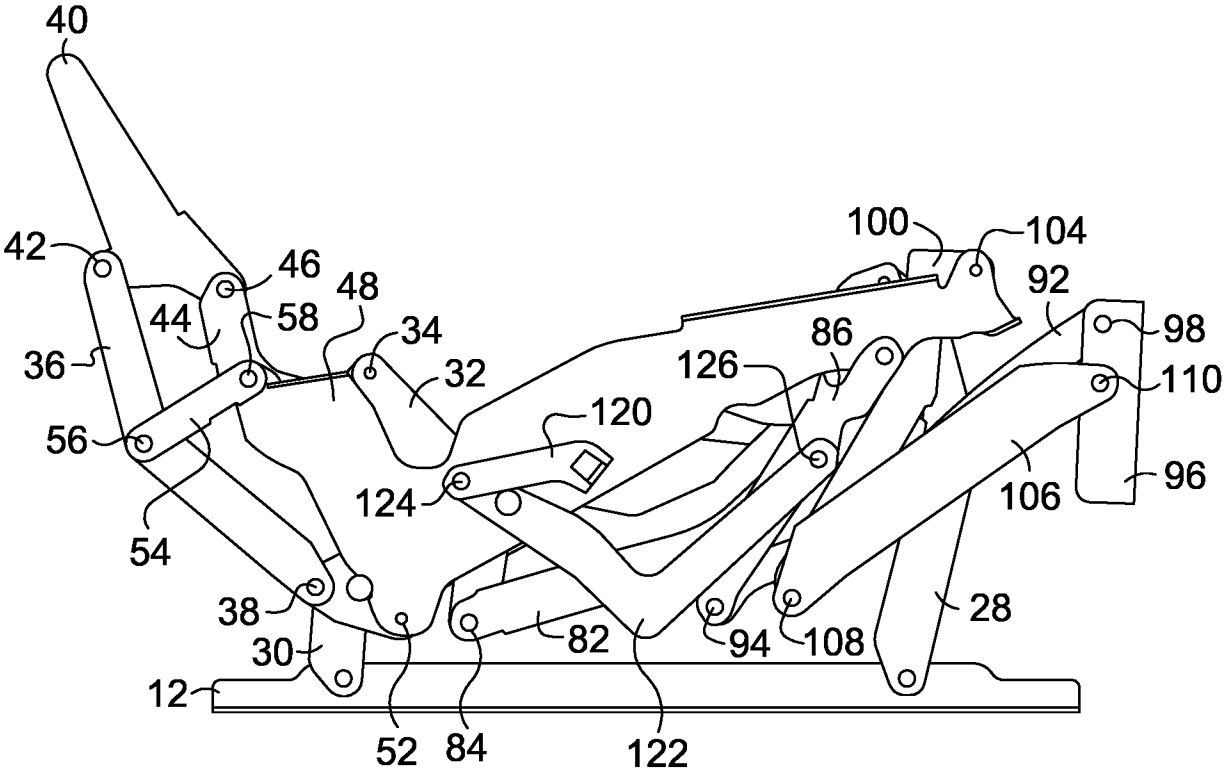
FIG. 3 depicts an outside elevation view of the exemplary manual recliner mechanism of FIG. 2 in the closed position in accordance with an embodiment hereof.

An exemplary linkage mechanism will now be described. In the illustrated embodiment of FIG. 2, the linkage mechanism 26 is pivotally coupled to the base rail 12 through a front pivot link 28 and a rear pivot link 30. The front pivot link 28 and the rear pivot link 30 each may rotate to move the recline mechanism from the closed position illustrated in FIGS. 2 and 3 to the one or more open positions (e.g., the TV position of FIGS. 4 and 5, the fully reclined position of FIGS. 1, 6 and 7, or some other intermediate position). The rear pivot link 30 extends upward from the base rail 12. The illustrated rear pivot link 30 of FIGS. 2 and 3 also extends forwardly from axis A, which extends normal to the base rail 12, as the illustrated aspect is a manually operated linkage mechanism 26. In other aspects, however, the rear pivot link 30 may extend rearwardly from axis A when the linkage mechanism is in the closed position, as discussed herein. The rear pivot link 30, like the remainder of the links described below is typically made from steel. The upper, forward end of the rear pivot link 30 is pivotally coupled to a rear lift link 32 at pivot point 34. The rear lift link 32 has a generally triangular shape, as shown. Forwardly and below pivot point 34 (as viewed in FIG. 1 where the linkage mechanism is in the fully reclined position), rear lift link 32 is pivotally coupled to a rear back pivot link 36 at pivot point 38. The rear back pivot link 36 extends upward and is pivotally coupled at its opposite end to a back bracket 40 at pivot point 42. The back bracket 40 is shaped as shown, with an upper extending leg that is used to couple the back bracket 40 to a back of the recliner. As seen in FIGS. 2 and 3, the forward, lower area of back bracket 40 is pivotally coupled to an upper end of a forward back pivot link 44 at pivot point 46. Referring back to FIG. 1, the lower end of forward back pivot link 44 is pivotally coupled to a seat mounting plate 48 at pivot point 50. In this way, the forward back pivot link 44 is an intermediate link that indirectly couples the seat mounting plate 48 to the back bracket 40. The rear lift link 32 is also coupled to the seat mounting plate 48 at pivot point 52, which is below pivot point 50.

As best seen in FIG. 3, a rearward end of a control link 54 is pivotally coupled to the rear back pivot link 36 at intermediate pivot point 56. The forward end of the control link 54 is pivotally coupled to the seat mounting plate 48 at pivot point 58, which is rearward of pivot point 50 (as best seen in FIG. 1).

Figure 4:
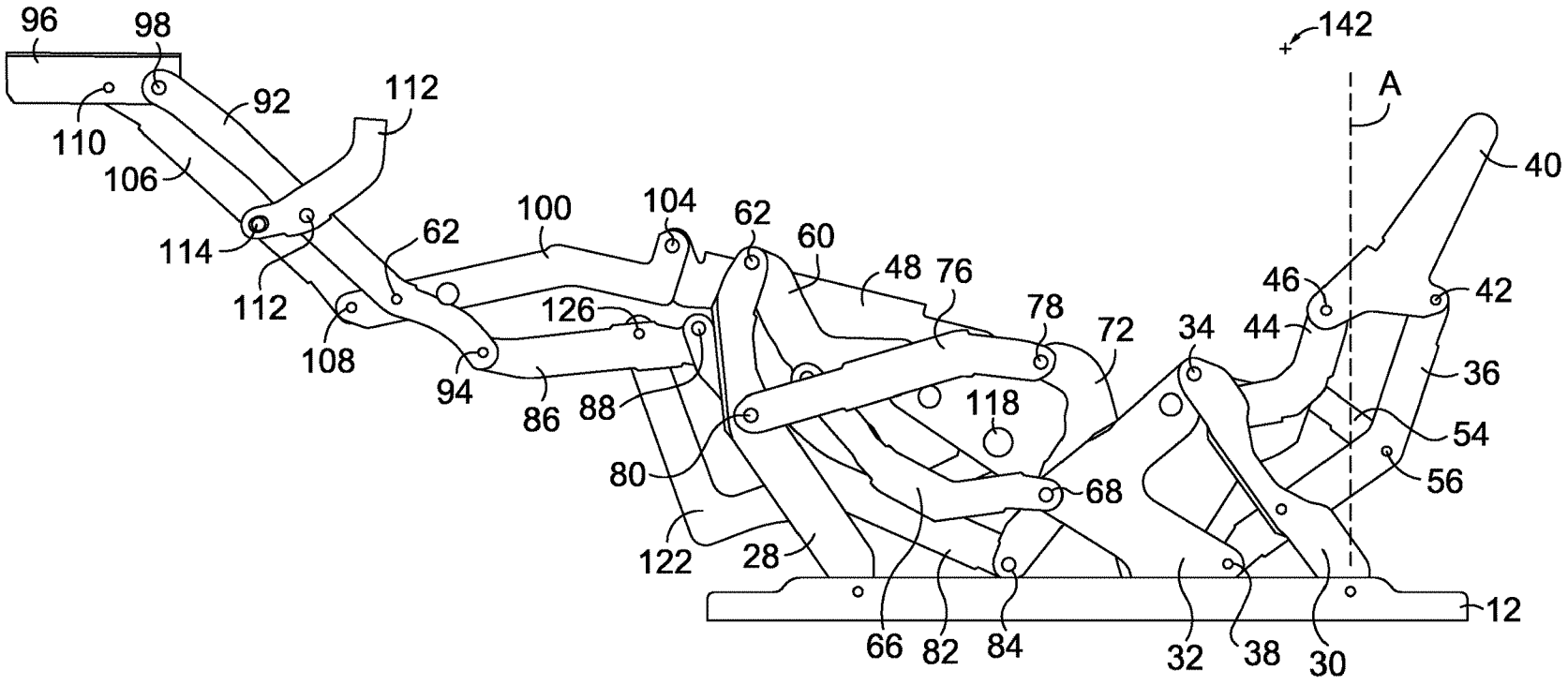
FIG. 4 depicts an inside elevation view of the exemplary manual recliner mechanism in the TV position in accordance with an embodiment hereof.

Turning to FIG. 4, the front pivot link 28 extends upward from the base rail 12. In some embodiments, the front pivot link 28 may extend forwardly away from the axis A when the recliner is in the closed position. In other embodiments, the front pivot link 28 may extend rearwardly towards the axis A when the recliner is in the closed position. The front pivot link 28 may extend rearwardly even in a manual version of the recliner because the rear pivot link 30 extends forwardly in a manual version and will drive the front pivot link 28 forward when the recliner moves from the closed position to one of the open positions (e.g., the TV position). The upper end of the front pivot link 28 is pivotally coupled to a front lift link 60 at pivot point 62. Rearwardly of pivot point 62 (as viewed in FIG. 6), the front lift link 60 is pivotally coupled to the seat mounting plate 48 at pivot point 64. A connector link 66 is pivotally coupled on one end to the rear lift link 32 at pivot point 68. The connector link 66 is pivotally coupled on the other end to the front lift link 60 at intermediate pivot point 70.

Figure 6:
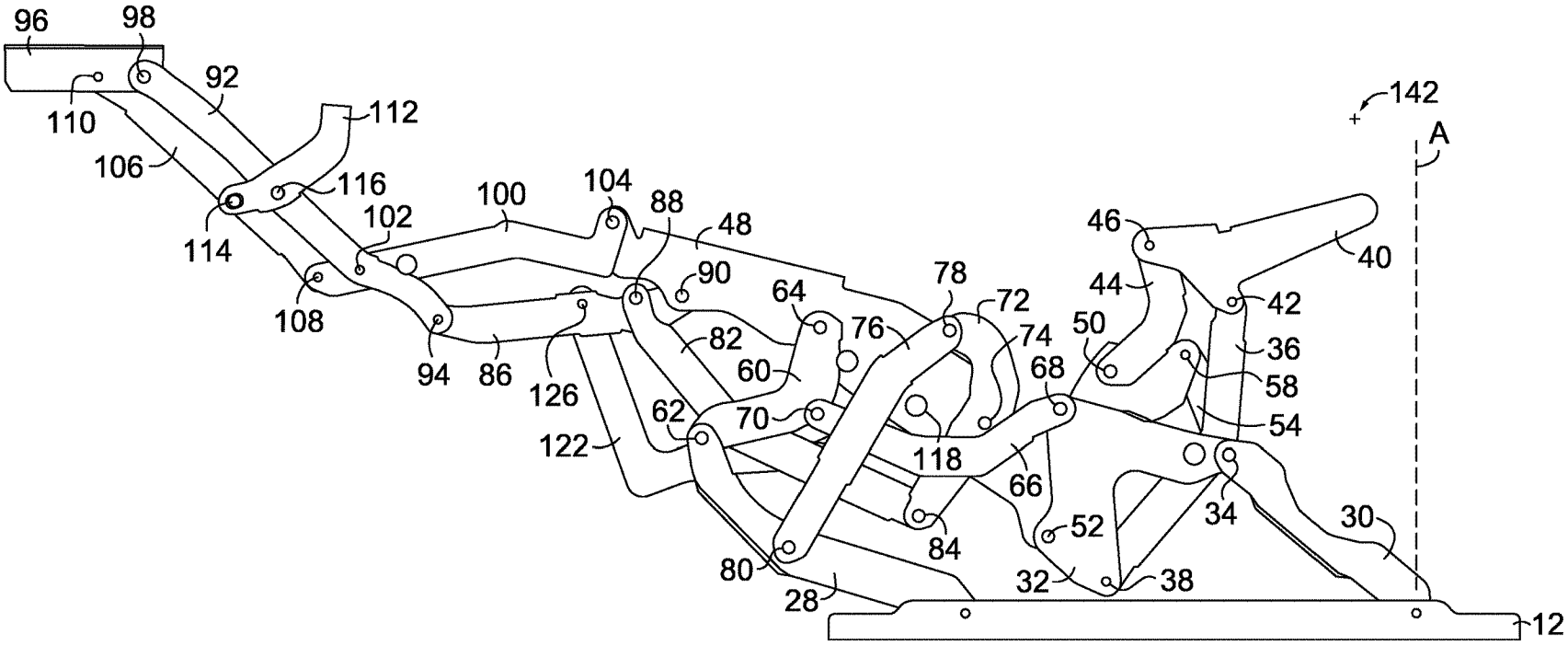
FIG. 6 depicts an inside elevation view of the exemplary manual recliner mechanism in the fully reclined position in accordance with an embodiment hereof.

Referring to FIG. 6, a bell crank 72 is pivotally coupled to the seat mounting plate 48 at pivot point 74. The bell crank 72 is shaped as shown, having pivot point 74 at an intermediate position between a first end and a second end. The first end of the bell crank 72 extends upwardly from the pivot point 74 and is pivotally coupled to a rear end of a crank connector link 76 at pivot point 78. As viewed in FIG. 4, a front end of the crank connector link 76 is pivotally coupled to the front pivot link 28 at intermediate pivot point 80. Returning to FIGS. 6 and 7, the second end of the bell crank 72 extends downwardly from the pivot point 74 and is pivotally coupled to a footrest drive link 82 at pivot point 84. The footrest drive link 82 extends from the connection to the bell crank 72 forwardly and is pivotally coupled on its forward end to a rear ottoman link 86 at intermediate pivot point 88. The rear ottoman link 86 is pivotally coupled on its rear, upper end to the seat mounting plate 48 at pivot point 90. The opposite end of the rear ottoman link 86 is pivotally coupled to a main ottoman link 92 at pivot point 94. In the fully reclined position (shown in FIGS. 6 and 7), the main ottoman link 92 extends upwardly and forwardly from the rear ottoman link 86. The upward, forward end of the main ottoman link 92 is pivotally coupled to an ottoman bracket 96 at pivot point 98.

Additionally, the main ottoman link 92 is pivotally coupled, at an intermediate point, to a front ottoman link 100 at pivot point 102. The front ottoman link 100 is pivotally coupled on one end to the seat mounting plate 48 at pivot point 104, and is pivotally coupled on the other end to a shielded ottoman link 106 at pivot point 108. The shielded ottoman link 106 is pivotally coupled on its other end to the ottoman bracket 96 at pivot point 110. An intermediate point of the shielded ottoman link 106 is pivotally and slidably coupled to a mid-ottoman bracket 112 at slidable pivot point 114. A mid-point of the mid-ottoman bracket 112 is pivotally coupled, at an intermediate point, to the main ottoman link 92 at pivot point 116.

The recline mechanism described above can be implemented as a motorized or manual version, depending on the desired end use. As a manual version, as best seen in FIGS. 2-7, a drive tube (not shown) is pivotally coupled to the seat mounting plate 48 at pivot point 118. The drive tube is controlled by a lock mechanism. The lock mechanism includes a lock bracket 120 and a lock link 122, best seen in FIGS. 3, 5, and 7. The lock bracket 120 is coupled on one end to the drive tube and configured to operatively lock the recline mechanism in the closed position (FIG. 3). The other end of the lock bracket 120 is pivotally coupled to a rear end of the lock link 122 at pivot point 124. The front end of the lock link 122 is pivotally coupled, generally at a mid-point, to the rear ottoman link 86 at pivot point 126.

Returning to the aspect illustrated in FIG. 1, as a motorized version a motor tube 128 is secured tothe footrest drive link 82. More specifically, a motor tube bracket 130 is fixedly secured to the footrest drive link 82 at coupling point 132. The opposite end of the motor tube bracket 130 is fixedly coupled to the motor tube 128, such as by welding. A clevis 134 is fixedly coupled to the motor tube 128 midway along the motor tube 128, facilitating a pivotal coupling to one end of a motor driven trolley 136. The trolley 136 rides along a track 138. The track 138 is supported on a front end by the trolley 136 and on the opposite end by one of the cross members 14 to which the track 138 is fixedly coupled. A motor 140 drives the trolley 136 along the track 138 and holds the trolley 136 at positions associated with the recline mechanism being in at least the closed position, the TV position, and the fully reclined position.

Figure 5:
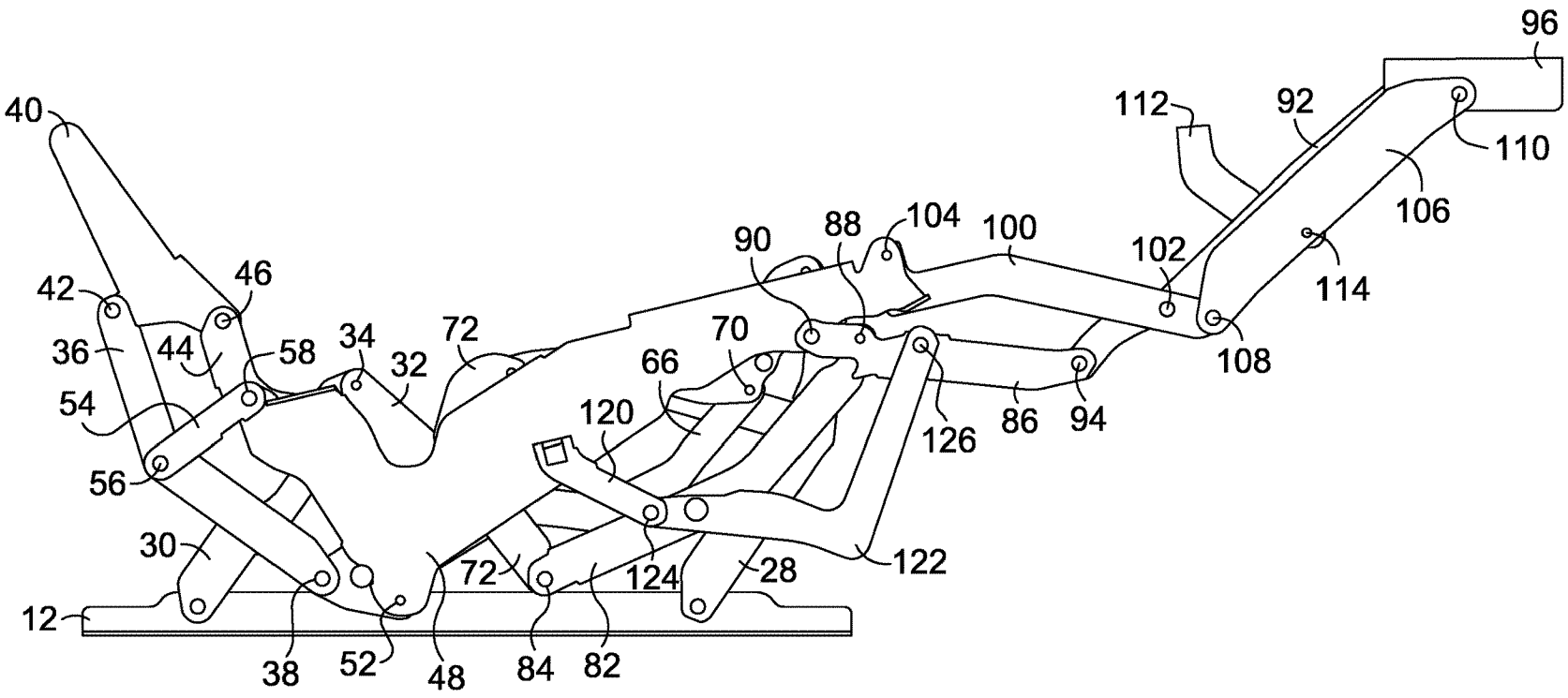
FIG. 5 depicts an outside elevation view of the exemplary manual recliner mechanism of FIG. 4 in the TV position in accordance with an embodiment hereof.
Figure 7:
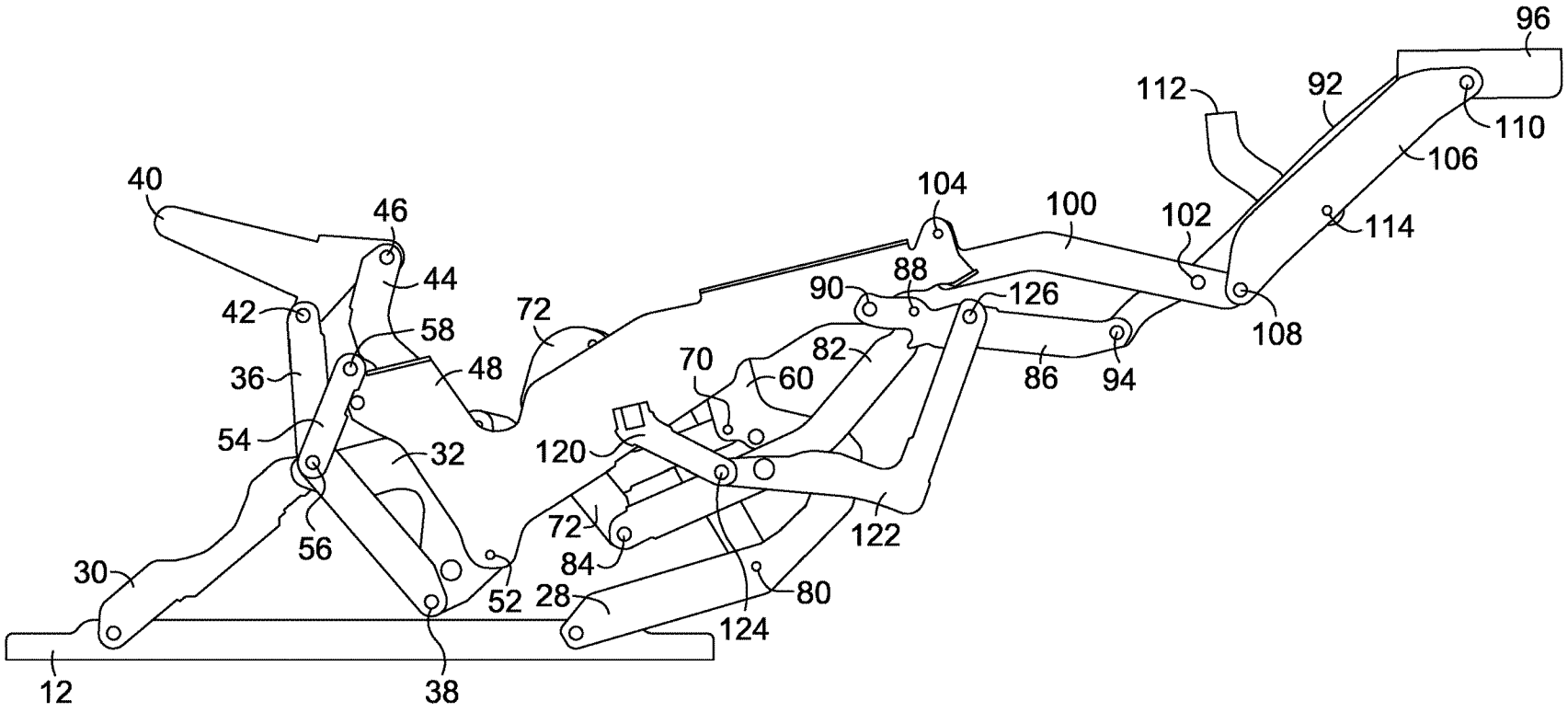
FIG. 7 depicts an outside elevation view of the exemplary manual recliner mechanism of FIG. 6 in the fully reclined position in accordance with an embodiment hereof.

The recline mechanism may move between the closed position of FIGS. 2 and 3, to the TV position of FIGS. 4 and 5, to the full recline position of FIGS. 1, 6 and 7. The arrangement of the recline mechanism provides a projected pivot point 142 (as shown in FIGS. 2, 4, and 6) for the chair back that is close to the point at which the bottom of a chair back cushion and the back of a seat cushion meet, when in a finished chair. In styling a finished chair, the manufacturer can design the chair back and seat such that they meet as close to the projected pivot point 142 as possible. The back bracket 40 pivotally coupled to the rear back pivot link 36 and the forward back pivot link 44, moved through the rear lift link 32 and front lift link 60 through the seat mounting plate 48 and controlled with the back control link 54 allow the projected pivot point 142 of back bracket 40 (in relation to the seat mounting plate 48) to be projected forwardly, and above, the actual pivotal coupling of back bracket 40. As a result of the projected pivot point 142 being forward of the back bracket 40, the back bracket 40 swings forward as the chair reclines to the TV position (as seen in the position of the back bracket 40 relative to the axis A between FIGS. 2 and 4) and moves forward again as the chair reclines to the fully reclined position (as seen in the position of the back bracket 40 relative to the axis A between FIGS. 4 and 6). Thus, a finished chair having the above described recline mechanism requires less wall clearance than typical recliners because of the forward movement gained from having the back bracket 40 rotate about the projected pivot point 142 and as opposed to the typical direct coupling of the back bracket to the seat mounting plate. Indeed, the above described recline mechanism provides a reduced wall clearance below what was previously thought possible. Previously, recliners needed at least 4.5 inches of wall clearance. With the above described recline mechanism, manual recliners need only two inches of wall clearance while motorized reclines do not require any wall clearance (i.e., zero inches of wall clearance).

Figure 8:
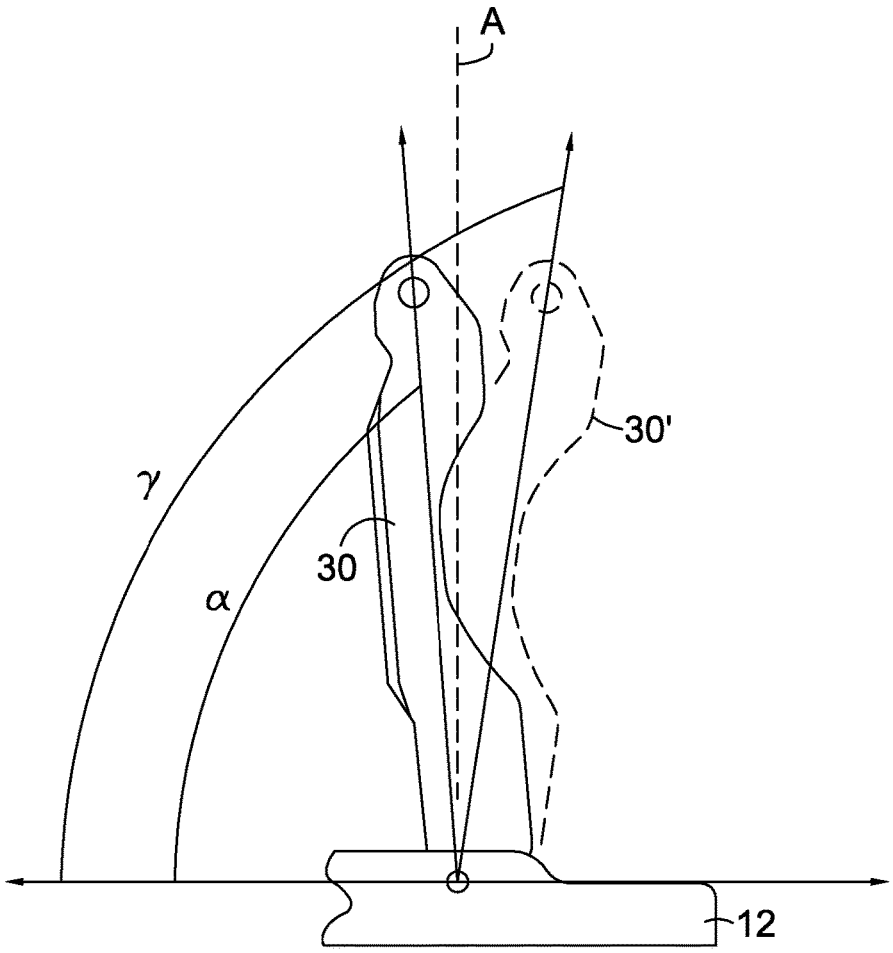
FIG. 8 depicts a section view showing a side-by-side comparison of the position of a rear pivot link in a manual version and a motorized version of an exemplary reclining mechanism when the reclining mechanism is in a closed position in accordance with an embodiment hereof.

Further, the connection of the motor 140 as described above allows the rear pivot link 30 to be set at an angle greater than 90 degrees from the base rail 12. More specifically, as shown in the side-by-side comparison of FIG. 8, in typical mechanisms the rear pivot link 30 extends at an angle $\alpha$ from the base rail 12, where the angle $\alpha$ must be less than 90 degrees when the recliner mechanism is in the closed position. As discussed above, the angle $\alpha$ previously had to be less than 90 degrees because the weight of the finished chair and the weight of the user of the finished chair would press down on the rear pivot link 30. Hence, if the angle $\alpha$ was greater than 90 degrees, the weight of the user and the finished chair would work against the user trying to manually open the recliner. In motorized versions, however, the rear pivot link 30' (shown in dashed lines for comparison purposes) extends at an angle γ from the base rail 12, where the angle γ can exceed 90 degrees when the recliner mechanism is in the closed position. The angle γ being greater than 90 degrees is possible because the motor 40 can lift the weight of the finished chair and the weight of the occupant and rotate the rear lift link 30' forward. Thus, a finished chair having the motorized version of the recliner mechanism 26 requires even less wall clearance than typical recliners because of the forward movement gained from having a longer path for the top end of the rear pivot link 30' to travel. In fact, in some embodiments, a finished chair having the motorized version of the recliner mechanism 26 requires zero wall clearance.

Some aspects of this disclosure have been described with respect to the illustrative examples provided by FIGS. 1-8. Additional aspects of the disclosure will now be described that may be related subject matter included in one or more claims of this application, or one or more related applications, but the claims are not limited to only the subject matter described in the below portions of this description. These additional aspects may include features illustrated by FIGS. 1-8, features not illustrated by FIGS. 1-8, and any combination thereof. When describing these additional aspects, reference may or may not be made to elements depicted by FIGS. 1-8.

One aspect disclosed herein is directed to a linkage mechanism including a seat mounting plate for mounting a recliner seat thereon, a back bracket for mounting a recliner back portion thereon and an intermediate link between the seat mounting plate and the back bracket. The seat mounting plate may have a first pivot point. The intermediate link may have a first end opposite a second end. The first end of the intermediate link may be pivotally connected to the seat mounting plate at the first pivot point. The back bracket may have a forward pivot point. The second end of the intermediate link may be pivotally connected to the back bracket at the forward pivot link. Upon forward motion of the seat mounting plate as the linkage mechanism unfolds from a closed position the forward pivot point may be moved forwardly and downwardly.

In some aspects, the linkage mechanism may also include a back support link having a back support link first end opposite a back support link second end. The back support link first end may be pivotally connected to the back bracket at a rear pivot point. The rear pivot point may be rearward of the forward pivot point. The back support link second end may be pivotally connected to a rear lift link rearward of a pivotal connection between the rear lift link and the seat mounting plate.

In other aspects the linkage mechanism may also include a back control link. The back control link may have a back control link first end opposite a back control link second end. The back control link first end may be pivotally connected to the back support link intermediate to the back support link first end and the back support link second end. The back control link second end may be pivotally connected to the seat mounting plate at a second pivot point. The second pivot point may be positioned rearward on the seat mounting plate from the first pivot point.

The linkage mechanism may be configured to move between the closed position and a fully reclined position. Whereupon movement of the linkage mechanism from the closed position to the fully reclined position the forward pivot point of the back bracket may be moved forwardly and upwardly. Whereupon movement of the linkage mechanism from the closed position to the fully reclined position the rear pivot point of the back bracket may be moved forwardly and downwardly. In other aspects, whereupon movement of the linkage mechanism from the closed position to the fully reclined position the back bracket may rotate around a projected pivot point. The projected pivot point may be forward and above the forward pivot point of the back bracket when the linkage mechanism is in the closed position. The projected pivot point may be rearward and above the forward pivot point of the back bracket when the linkage mechanism is in the fully reclined position.

In some aspects, the linkage mechanism is configured to stop at a TV position intermediate to the closed position and the fully reclined position. The linkage mechanism may also include a motor coupled to the linkage mechanism. The motor may be configured to move the linkage mechanism between the closed position and the fully reclined position. In other aspects, the linkage mechanism is configured to be manually moved between the closed position and the fully reclined position.

Another aspect disclosed herein is directed to a reclining seating unit requiring reduced wall clearance. The reclining seating unit may include a linkage mechanism having a seat mounting plate, a back bracket indirectly coupled to the seat mounting plate. The back bracket may be configured to move forward relative to the seat mounting plate as the seating unit moves from a closed position towards a fully reclined position. The reclining seating unit may also include a finished seat back coupled to the back bracket. The finished seat back may have a trailing edge comprising the rearwardmost edge of the reclining seating unit. The reclining seating unit may be configured to require between 0 inches and 4.5 inches of clearance rearward of the trailing edge when the reclining seating unit is in the closed position in order to for the seating unit to move unobstructed to the fully reclined position.

In other aspects, the reclining seating unit may also include an intermediate link that indirectly couples the back bracket to the seat mounting plate. The intermediate link may have a first end opposite a second end. The first end of the intermediate link may be pivotally connected to the seat mounting plate at a first pivot point. The second end of the intermediate link may be pivotally connected to the back bracket at a second pivot point.

The reclining seating unit may be configured to be manually moved between the closed position and the fully reclined position. Said reclining seating unit may require between 2 inches and 4.5 inches of clearance rearward of the trailing edge when the reclining seating unit is in the closed position in order for the reclining seating unit to move unobstructed to the fully reclined position. The reclining seating unit may also include a motor coupled to the linkage mechanism. The motor may be configured to move the reclining seating unit between the closed position and the fully reclined position.

Another aspect disclosed herein is directed to a motor-driven linkage mechanism. The motor-driven linkage mechanism may be configured to move between a closed position and a fully reclined position. A motor may be coupled to the linkage mechanism and configured to move the linkage mechanism between the closed position and the fully reclined position. A base rail having a forward end opposite a rearward end may be positioned beneath the linkage mechanism. A rear pivot link may be pivotally connected to the base rail at a first pivot point and pivotally connected to the linkage mechanism at a second pivot point. An angle between the base rail and a line extending from the first pivot point to the second pivot point may be an obtuse angle when the linkage mechanism is in the closed position.

The motor-driven linkage mechanism may also include a forward pivot link pivotally connected to the base rail at a third pivot point and pivotally connected to the linkage mechanism at a fourth pivot point, in accordance with some aspects. A second angle between the base rail and a line extending from the third pivot point to the fourth pivot point may be an obtuse angle when the linkage mechanism is in the closed position.

The angle between the base rail and the line extending from the first pivot point to the second pivot point may be an acute angle when the linkage mechanism is in the fully reclined position. The first pivot point may be forward of the second pivot point when the linkage mechanism is in the closed position.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A linkage mechanism comprising:

a seat mounting plate for mounting a recliner seat portion, the seat mounting plate having a first pivot point for pivotal connection to an intermediate link;

the intermediate link having a first end opposite a second end, wherein the first end of the intermediate link is pivotally connected to the seat mounting plate at the first pivot point;

a back bracket for mounting a recliner back portion, the back bracket having a forward pivot point, wherein the second end of the intermediate link is pivotally connected to the back bracket at the forward pivot point;

a back support link having a back support link first end opposite a back support link second end;

the back support link first end being pivotally connected to the back bracket at a rear pivot point, the rear pivot point being rearward of the forward pivot point; and the back support link second end being pivotally connected to a rear lift link rearward of a pivotal connection between the rear lift link and the seat mounting plate;

a back control link having a back control link first end opposite a back control link second end;

the back control link first end being pivotally connected to the back support link intermediate to the back support link first end and the back support link second end; and the back control link second end being pivotally connected to the seat mounting plate at a second pivot point, the second pivot point being positioned rearward on the seat mounting plate from the first pivot point, wherein upon forward motion of the seat mounting plate as the linkage mechanism unfolds from a closed position the forward pivot point is moved forwardly and downwardly.

2. The linkage mechanism of claim 1, wherein the linkage mechanism is configured to move between the closed position and a fully reclined position.

3. The linkage mechanism of claim 2, whereupon movement of the linkage mechanism from the closed position to the fully reclined position the forward pivot point of the back bracket is moved forwardly and upwardly.

4. The linkage mechanism of claim 2, whereupon movement of the linkage mechanism from the closed position to the fully reclined position, the rear pivot point of the back bracket is moved forwardly and downwardly.

5. The linkage mechanism of claim 2, whereupon movement of the linkage mechanism from the closed position to the fully reclined position, the back bracket rotates around a projected pivot point.

6. The linkage mechanism of claim 5, wherein the projected pivot point is forward and above the forward pivot point of the back bracket when the linkage mechanism is in the closed position.

7. The linkage mechanism of claim 5, wherein the projected pivot point is rearward and above the forward pivot point of the back bracket when the linkage mechanism is in the fully reclined position.

8. The linkage mechanism of claim 2, wherein the linkage mechanism is configured to stop at a TV position intermediate to the closed position and the fully reclined position.

9. The linkage mechanism of claim 2 further comprising a motor coupled to the linkage mechanism, the motor configured to move the linkage mechanism between the closed position and the fully reclined position.

10. The linkage mechanism of claim 2, wherein the linkage mechanism is configured to be manually moved between the closed position and the fully reclined position.

11. A reclining seating unit comprising:

a linkage mechanism comprising:

(A) a seat mounting plate;

(B) a back bracket indirectly coupled to the seat mounting plate, wherein the back bracket is configured to move forward relative to the seat mounting plate as the seating unit moves from a closed position towards a fully reclined position; and a finished seat back coupled to the back bracket, the finished seat back having a trailing edge comprising the rearwardmost edge of the reclining seating unit, wherein the reclining seating unit is configured to require between 0 inches and 4.5 inches of clearance rearward of the trailing edge when the reclining seating unit is in the closed position in order for the seating unit to move unobstructed to the fully reclined position.

12. The reclining seating unit of claim 11 further comprising:

an intermediate link that indirectly couples the back bracket to the seat mounting plate, the intermediate link having a first end opposite a second end, the first end of the intermediate link is pivotally connected to the seat mounting plate at a first pivot point and the second end of the intermediate link is pivotally connected to the back bracket at a second pivot point.

13. The reclining seating unit of claim 11, wherein the reclining seating unit is configured to be manually moved between the closed position and the fully reclined position, wherein the reclining seating unit requires between 2 inches and 4.5 inches of clearance rearward of the trailing edge when the reclining seating unit is in the closed position in order for the reclining seating unit to move unobstructed to the fully reclined position.

14. The reclining seating unit of claim 11, further comprising a motor coupled to the linkage mechanism, the motor configured to move the reclining seating unit between the closed position and the fully reclined position.

15. A motor-driven linkage mechanism comprising:

a linkage mechanism configured to move between a closed position and a fully reclined position;

a motor coupled to the linkage mechanism and configured to move the linkage mechanism between the closed position and the fully reclined position;

a base rail having a forward end opposite a rearward end and positioned beneath the linkage mechanism; and a rear pivot link pivotally connected to the base rail at a first pivot point and pivotally connected to the linkage mechanism at a second pivot point, wherein an angle between the base rail and a line extending from the first pivot point to the second pivot point is an obtuse angle when the linkage mechanism is in the closed position, wherein the first pivot point is forward of the second pivot point when the linkage mechanism is in the closed position.

16. The motor-driven linkage mechanism of claim 15 further comprising:

a forward pivot link pivotally connected to the base rail at a third pivot point and pivotally connected to the linkage mechanism at a fourth pivot point, wherein a second angle between the base rail and a line extending from the third pivot point to the fourth pivot point is an obtuse angle when the linkage mechanism is in the closed position.

17. The motor-driven linkage mechanism of claim 15, wherein the angle between the base rail and the line extending from the first pivot point to the second pivot point is an acute angle when the linkage mechanism is in the fully reclined position.

18. The motor-driven linkage mechanism of claim 16, wherein the third pivot point is forward of the fourth pivot point when the linkage mechanism is in the closed position.

19. The motor-driven linkage mechanism of claim 17, wherein the first pivot point is rearward of the second pivot point when the linkage mechanism is in the fully reclined position.

* * * * *